US007518077B2

(12) United States Patent
Guo

(10) Patent No.: US 7,518,077 B2
(45) Date of Patent: Apr. 14, 2009

(54) SLIDE BUTTON AND CASING USING THE SAME

(75) Inventor: Shi-Kun Guo, Guangdong (CN)

(73) Assignees: Hong Fu Jin Precision Industry (Shen Zhen) Co., Ltd., Shenzhen, Guangdong Province; Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 28 days.

(21) Appl. No.: 11/309,394

(22) Filed: Aug. 3, 2006

(65) Prior Publication Data

US 2008/0029379 A1 Feb. 7, 2008

(51) Int. Cl.
*H01H 15/10* (2006.01)

(52) U.S. Cl. ..... 200/547; 200/536

(58) Field of Classification Search ..... 200/547–550, 200/252

See application file for complete search history.

(56) References Cited

U.S. PATENT DOCUMENTS 3,461,252 A * 8/1969 Vananzi ..... 200/16 C
4,841,105 A * 6/1989 Goodman et al. ..... 200/16 D
5,051,549 A 9/1991 Takano
5,967,302 A * 10/1999 Lin ..... 200/550
6,841,744 B1 * 1/2005 Kodo et al. ..... 200/16 C
6,858,812 B2 2/2005 Sasaki et al.
6,960,734 B1 11/2005 Park
6,989,504 B1 1/2006 Wu
6,998,554 B2 2/2006 Shimoda et al.
7,002,085 B2 2/2006 Ullmann et al.
7,022,931 B2 4/2006 Shimoda et al.

* cited by examiner

*Primary Examiner*—Elvin G Enad
*Assistant Examiner*—Lheiren Mae A Anglo
(74) *Attorney, Agent, or Firm*—Winston Hsu

(57) ABSTRACT

An electronic device includes a cover with a housing therein, a base coupled to the cover so as to form a receiving space, a circuit board received in the receiving space, and a slide button mounted to the cover. A bottom of the housing defines a first cutout and a second cutout therein. The circuit board includes a switch mounted thereon. The slide button includes an operating portion, an activating portion, and a positioning portion. The operating portion is slideably received in the housing for being operated to slide the operating portion in the housing. The activating portion extends from the operating portion through the first cutout. The positioning portion connects to the activating portion, and is spaced apart from the operating portion. The positioning portion is insertable through the second cutout and is blockable by the bottom from disengaging from the second cutout.

16 Claims, 7 Drawing Sheets

SLIDE BUTTON AND CASING USING THE SAME

DESCRIPTION

1. Field of the Invention

The present invention generally relates to slide buttons and, more particularly, to a slide button of a single piece and a casing with the slide button accommodated therein.

2. Description of Related Art

Slide buttons have many applications and are given much attention. As such, slide buttons are widely employed in microcomputers, household appliances, computer peripherals, etc. A slide button is provided on one of various commercially available electronic products. The slide button is implemented as an on/off switch, a mode switch, or an opening/closing switch of a component of the electronic product.

Conventionally, a typical slide button of a slide button is a two-piece assembled button. That is, the slide button includes two pieces snapped together to be mounted to a case of an electronic product.

However, a number of disadvantages have been found in the prior slide button. For example, the slide button is with a complex structure. Further, its assembly is a tedious and time consuming process.

Accordingly, a need exists for a slide button without the above disadvantages in the industry.

SUMMARY OF THE INVENTION

In one aspect, an electronic device is provided. The electronic device includes a cover with a housing therein, a base coupled to the cover so as to form a receiving space, a circuit board received in the receiving space, and a slide button mounted to the cover. A bottom of the housing defines a first cutout and a second cutout therein. The circuit board includes a switch mounted thereon. The slide button includes an operating portion, an activating portion, and a positioning portion. The operating portion is slideably received in the housing for being operated to slide the operating portion in the housing. The activating portion extends from the operating portion through the first cutout. The positioning portion connects to the activating portion, and is spaced apart from the operating portion. The positioning portion is insertable through the second cutout and is blockable by the bottom from disengaging from the second cutout.

In another aspect, a cover for an electronic device which includes a switch for shifting a mode is provided. The cover includes a housing formed on a side wall of the cover, and an integrally formed slide button attached to the cover. The housing includes a bottom depressed from the side wall and a periphery surrounding the bottom. The bottom defines a first cutout and a second cutout communicating with the first cutout. The slide button includes an operating portion for being applied a pushing force thereon to slide the slide button, an activating portion for triggering the switch, and a positioning portion cooperating with the operating portion to sandwich the bottom therebetween. The activating portion is inserted into the cover through the first cutout. The positioning portion is inserted into the cover through the first and second cutouts.

In another aspect, an electronic device includes a casing forming a button receiving portion, a circuit board received in the casing, a switch mounted on the circuit board, and a button moveably received in the button receiving portion. The switch includes a tip moveable for performing switching. The button is a single piece and includes a first portion for being applied a force on a first surface thereof to move the button along a moving direction, a second portion substantially perpendicularly extending from a second surface of the first portion opposite to the first surface, and a third portion positioning the button to the casing together with the first portion in a manner so as to prevent the button from becoming disengaged from the casing. The second portion is inserted into the casing to so as to move the tip of the switch When the force is applied to the first portion.

Other systems, methods, features, and advantages of the present slide button and the present case with the slide button will be or become apparent to one with skill in the art upon examination of the following drawings and detailed description. It is intended that all such additional systems, methods, features, and advantages be included within this description, be within the scope of the present apparatus, and be protected by the accompanying claims.

BRIEF DESCRIPTION OF THE DRAWINGS

Many aspects of the present slide button and the present case with the slide button can be better understood with reference to the following drawings. The components in the drawings are not necessarily to scale, emphasis instead being placed upon clearly illustrating the principles of the present device. Moreover, in the drawings, like reference numerals designate corresponding parts throughout the several views.

DETAILED DESCRIPTION OF THE INVENTION

Reference will now be made to the drawings to describe the preferred embodiments of the present slide button and the present case with the slide button, in detail.

Figure 1:
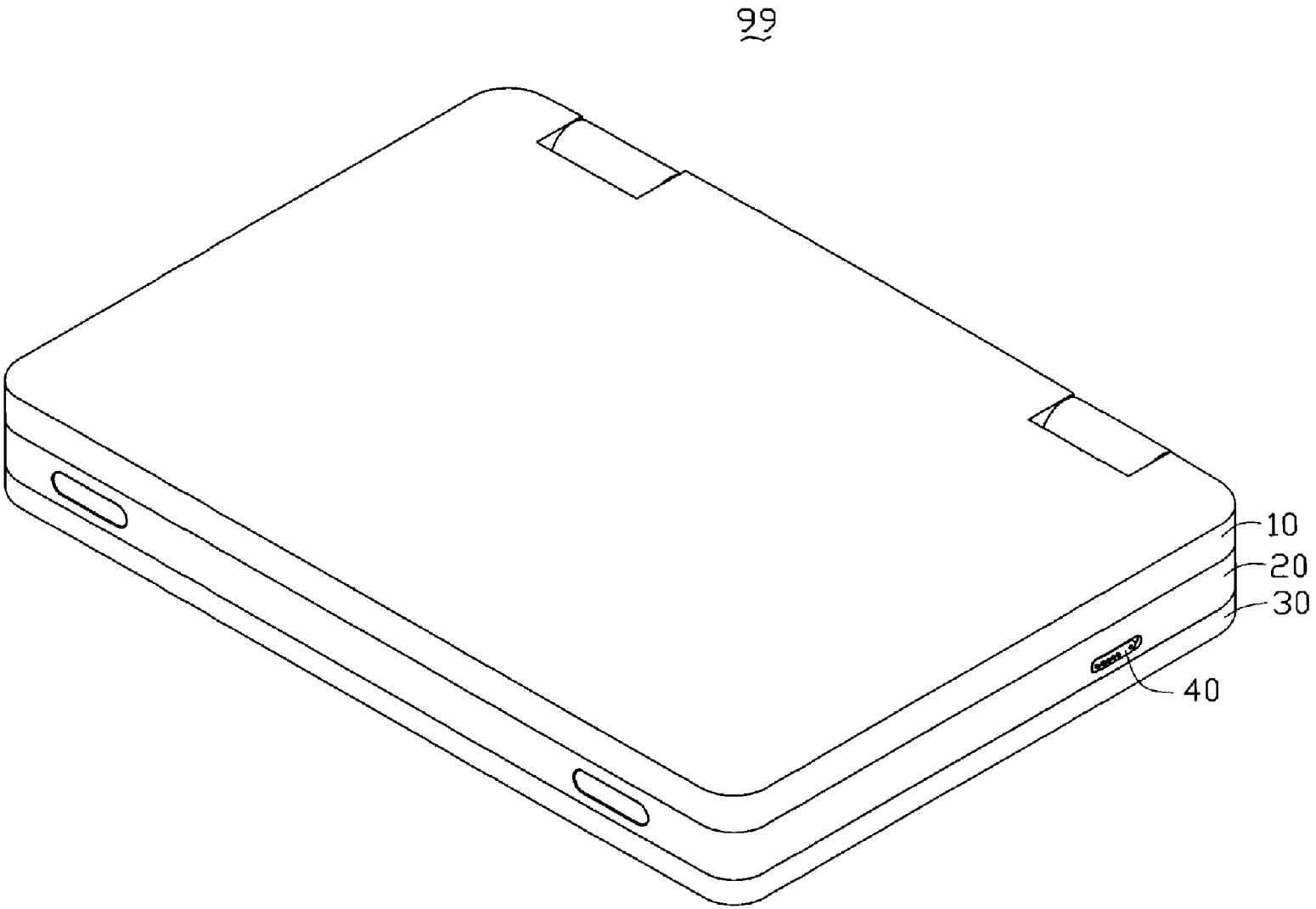
FIG. 1 is an isometric view of an electronic device with a slide button in accordance with an exemplary embodiment mounted thereto.
Figure 2:
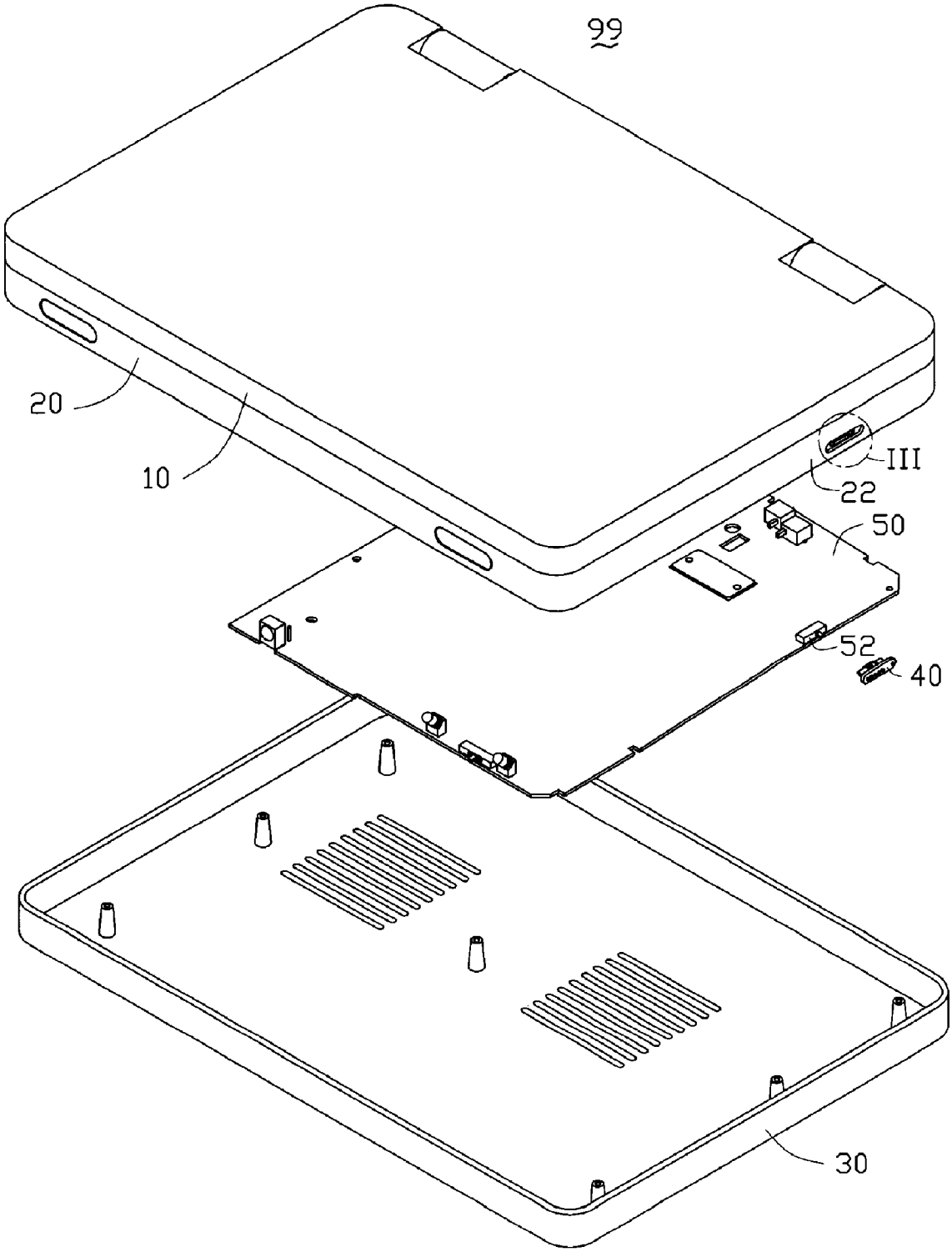
FIG. 2 is an exploded view of the electronic device of FIG. 1, the electronic device including a cover, a base, and a circuit board.

Referring to FIG. 1 and FIG. 2, an electronic device 99 includes a lid 10, a cover 20, a base 30, a slide button 40, and a circuit board 50. The lid 10 is pivoted to the cover 20. The cover 20 and the base 30 are coupled together to receive the circuit board 50. The slide button 40 is attached to a side wall 22 of the cover 20 to activate a mode of the electronic device 99 by operating a toggle switch 52 on the circuit board 50.

Figure 3:
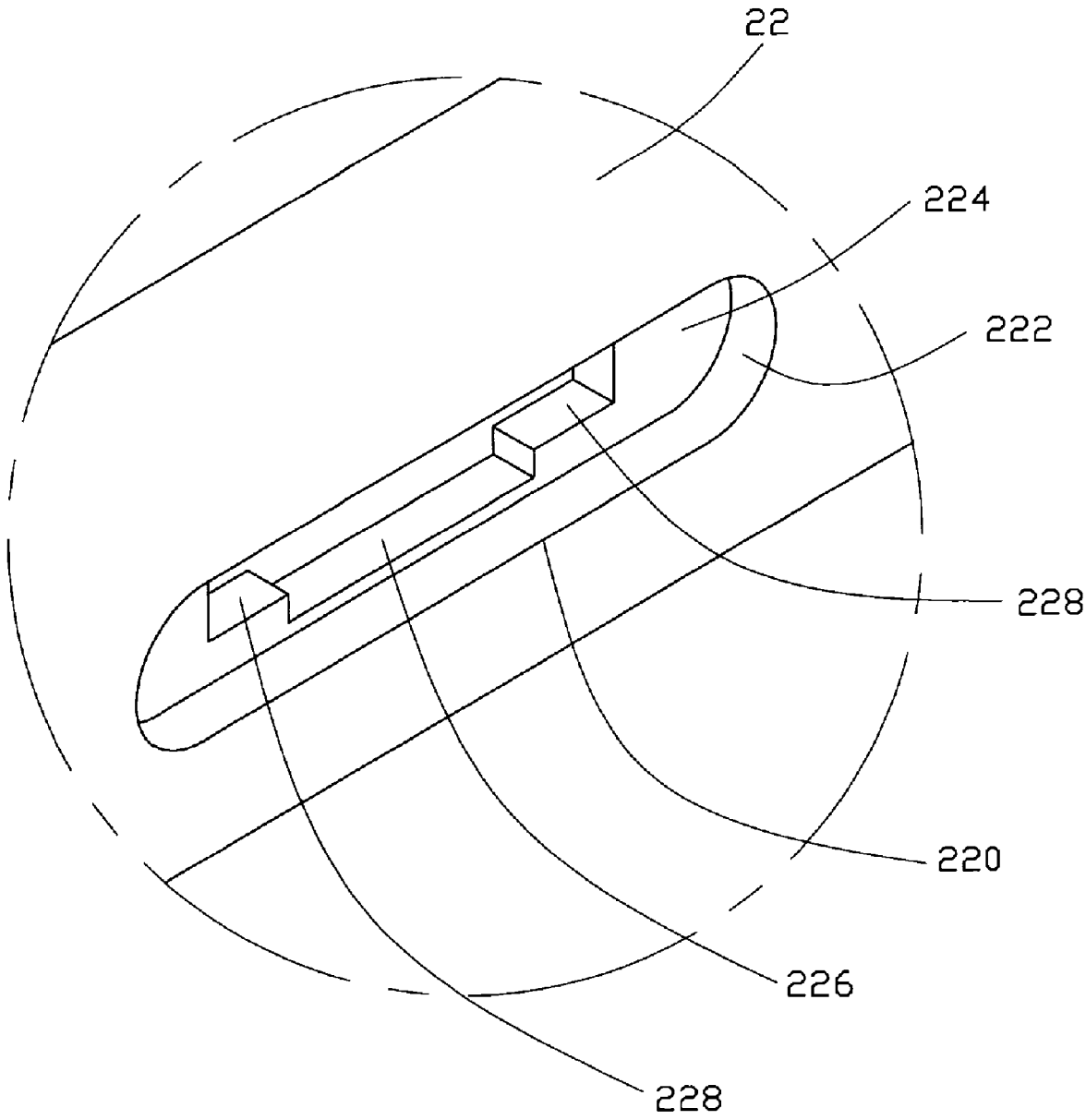
FIG. 3 is an enlarged view of circled portion III of the cover in FIG. 2.

Referring to FIG. 3, the side wall 22 forms an oblong housing 220 to receive the slide button 40. The housing 220 is depressed from the side wall 22, and includes a periphery 222 and a bottom 224 surrounded by the periphery 222. A rectangular first cutout 226 and a pair of rectangular second cutouts 228 are successively defined in the bottom 224 of the housing 220. The first cutout 226 has a larger width than that of the second cutouts 228, is positioned between the second cutouts 228, and communicates with the second cutouts 228.

Figure 4:
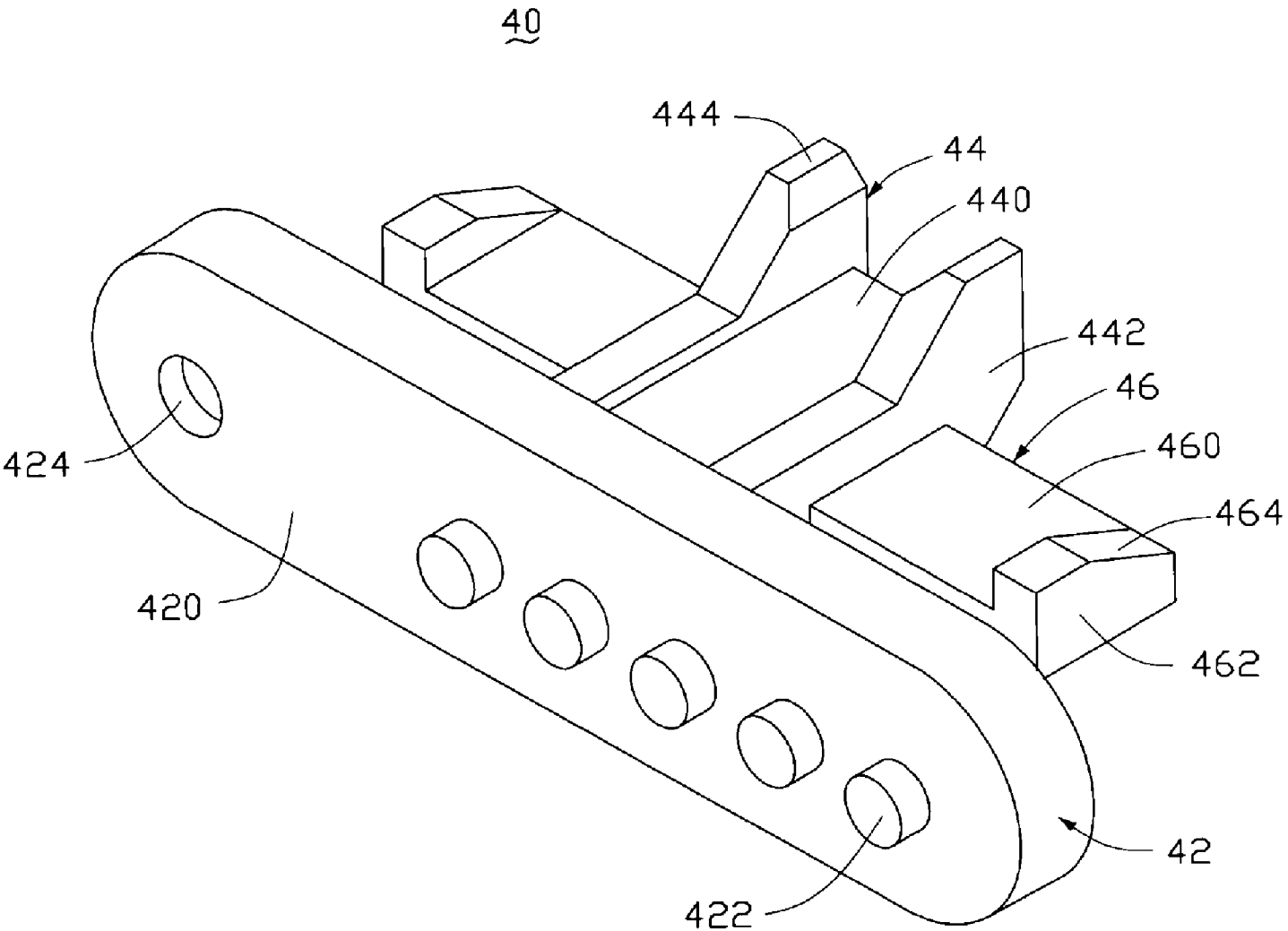
FIG. 4 is an enlarged view of the slide button of FIG. 2, but viewed from an inverted aspect.
Figure 5:
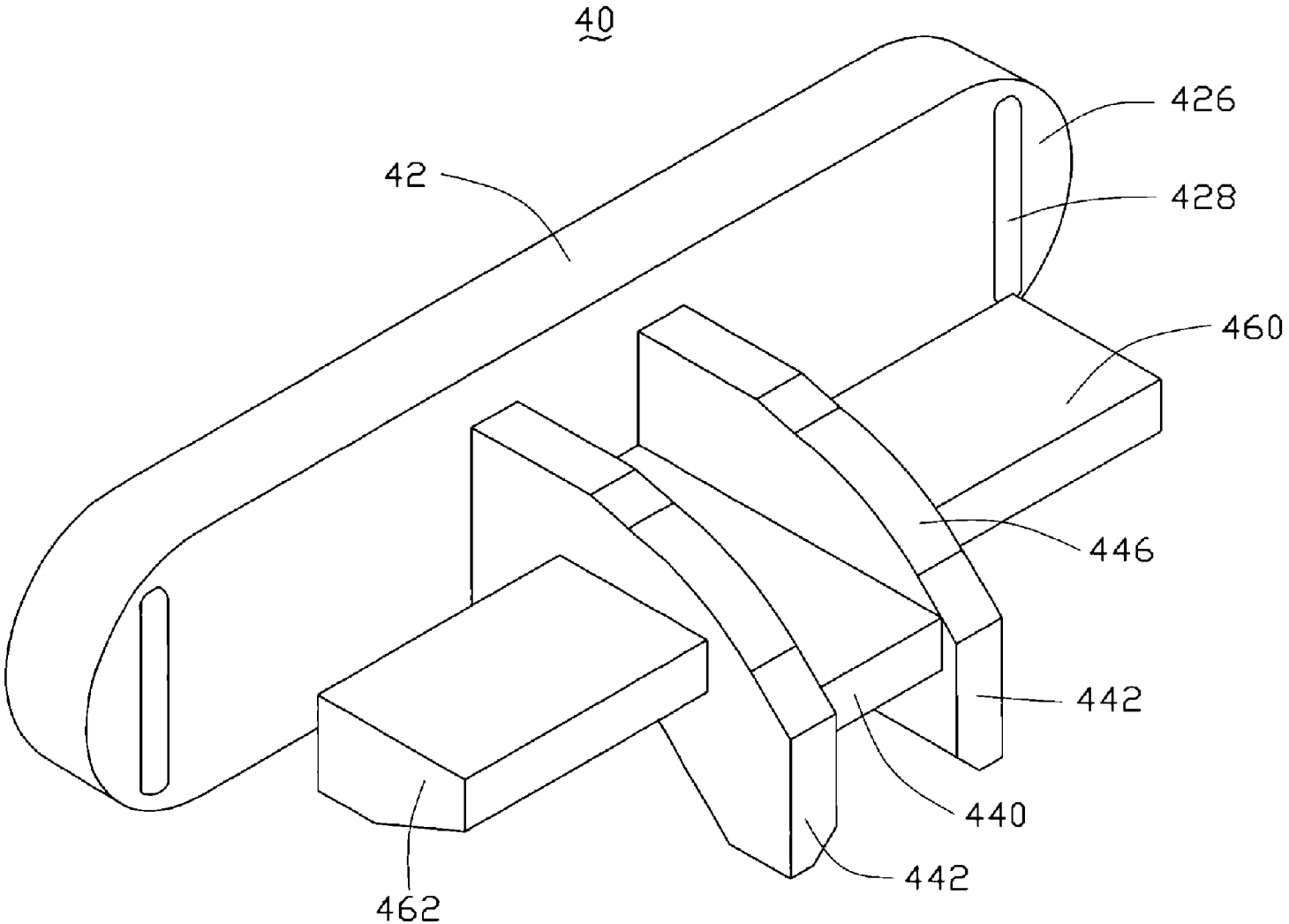
FIG. 5 is similar to FIG. 4, but viewed from another aspect.

Referring to FIG. 4 and FIG. 5, the slide button 40 is integrally formed, and includes an operating portion 42, an activating portion 44, and a positioning portion 46. The activating portion 44 connects to the operating portion 42, and intersects with the positioning portion 46.

The operating portion 42 is an oblong piece for users to operate thereon. The operating portion 42 is received in the housing 220, and slideably reciprocates along a sliding direction parallel to an elongated side of the housing 220. A plurality of projections 422 extends perpendicularly from a first surface 420 of the operating portion 42 to increase static friction between operators and the operating portion 42. The projections 422 are used for preventing slips when an operating force is applied on the operating portion 42. A recess 424 is defined in the first surface 420 for indicating a current mode of the electronic device 99 by aligning with a mark (not shown) printed or a scratch (not shown) carved on the side wall 22 of the cover 20. A pair of ribs 428 is formed on a second surface 426 opposite to the first surface 420, distributed on two lateral sides of the second surface 426. The ribs 428 are used for contacting with the bottom 224 of the housing 220 and decreasing a contacting area between the operating portion 42 and the bottom 224 as a result, thus allowing the operating portion 42 to smoothly slide in the housing 220.

The activating portion 44 extends from a center of the second surface 426, and is used for activating the toggle switch 52 on the circuit board 50 via the first cutout 226. The activating portion 44 includes a connecting board 440 perpendicularly extending from the second surface 426, and a pair of tail fins 442 sandwiching the connecting board 440 therebetween. Each of the tail fin 442 forms a tab 444 protruding therefrom at an end corner thereof, and forms a round corner 446 at an adjacent end corner for easily being inserted through the first cutout 226.

The positioning portion 46 extends out from the activating portion 44. The positioning portion 46 is spaced apart from the operating portion 42, and sandwiches the bottom 224 of the housing 220 together with the operating portion 42. The positioning portion 46 includes an extending board 460 and a pair of side fins 462. The extending board 460 intersects perpendicularly with the connecting board 440 of the activating portion 44. The side fins 462 each protrude from one of two opposite ends of the extending board 460. Each of the side fins 462 forms a wedge 464 at a tail thereof for easily extending through the corresponding second cutout 228.

Figure 6:
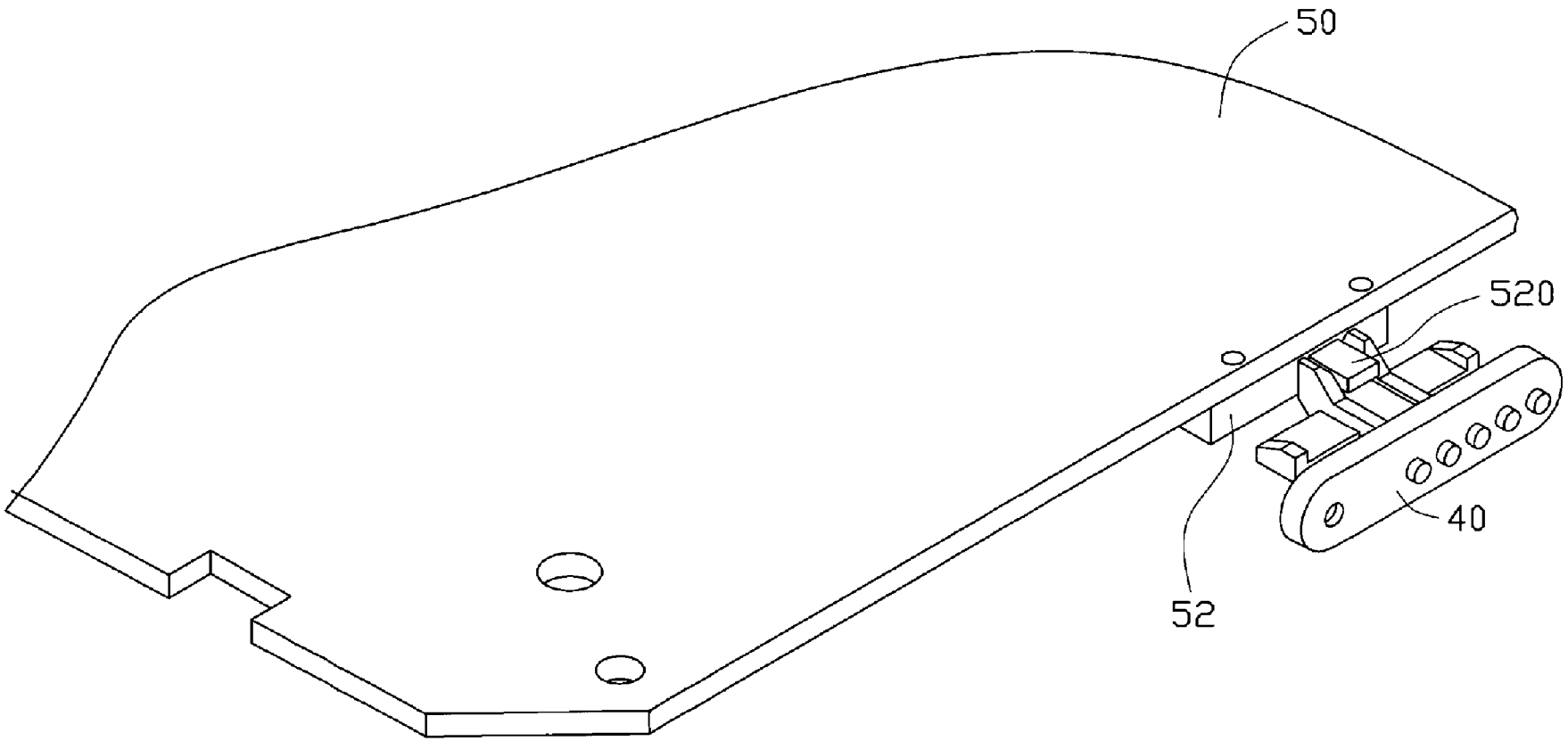
FIG. 6 is an inverted, partial view of the circuit board with the slide button mounted thereto.

Referring to FIG. 6, the toggle switch 52 is soldered on the circuit board 50 with a tip 520 thereof projected from the circuit board 50. The toggle switch 52 may be a two-stage switch or a multi-stage switch which can switch a current mode of the electronic device 99 between two or multiple modes by swaying or sliding the tip 520. The tip 520 of the toggle switch 52 is positioned between the tabs 444 of the tail fins 442, and is swayed or slided by the tabs 444.

Figure 7:
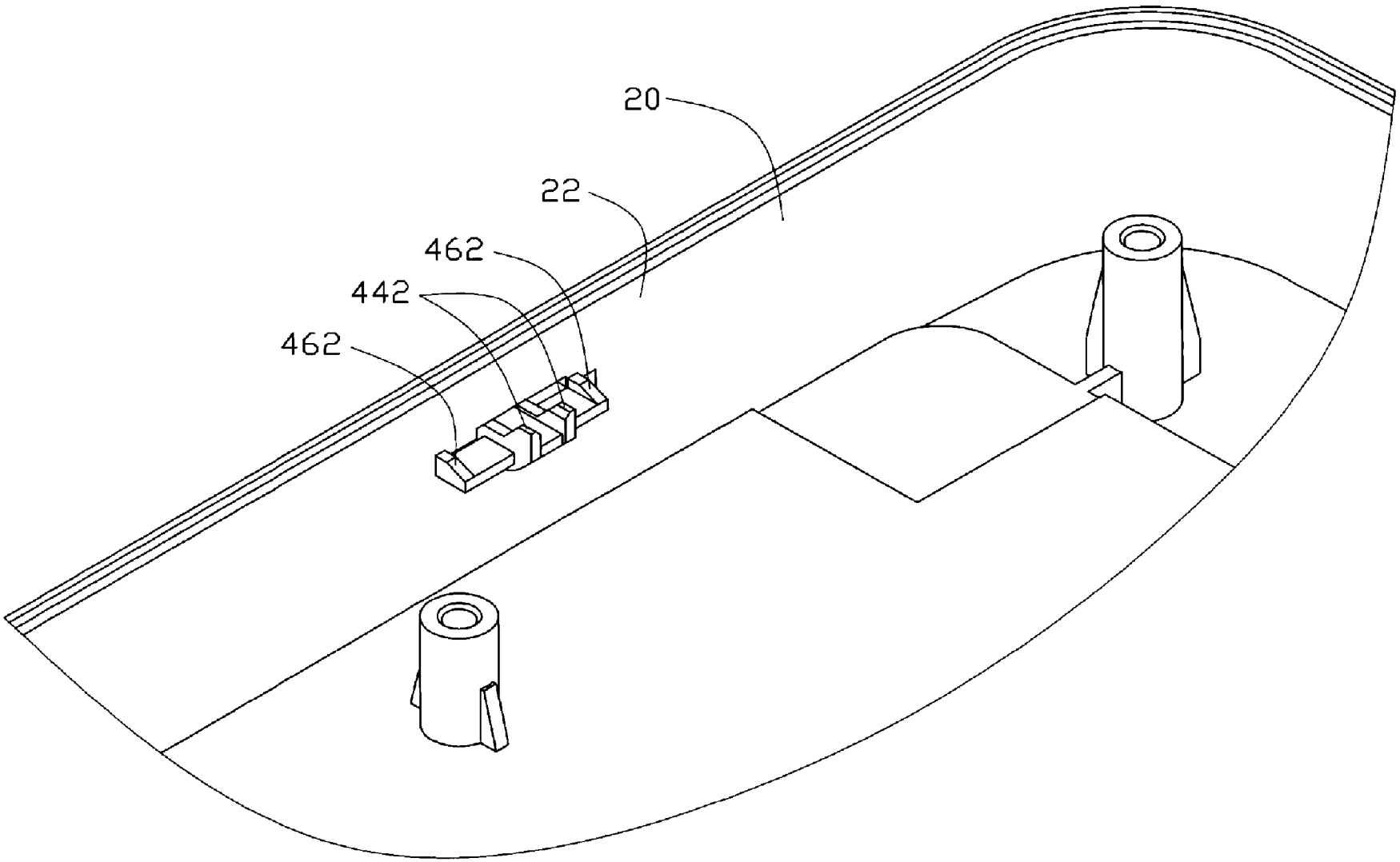
FIG. 7 is a partial view of the cover with the slide button mounted thereto.

Referring to FIG. 7, an assembly procedure of slide button 40 and the cover 20 will be detailedly described.

The tabs 444 of the tail fins 442 of the slide button 40 slantways extend through the first cutout 226 in the cover 20. The round corners 446 of the tail fins 442 rotate around contacting points of the tabs 444 and the bottom 224 of housing 220 to extend though the first cutout 226 of the cover 20. After the above extending and rotating procedures, rear portions of the tail fins 442 are across the bottom 224 of the housing 220, and the slide button 40 is horizontally positioned.

The wedges 464 of the side fins 462 are gradually inserted into the second cutouts 228 in the cover 20, and crush through the second cutouts 228 to secure to the cover 20 with the operating portion 42 and the positioning portion 46 sandwiching the bottom 224 of the housing 220 therebetween. The side fins 464 are blocked by the bottom 226 of the housing 220 to prevent the slide button 40 from disengaging from the cover 20.

Referring to FIG. 2 and FIG. 6, after the above assembly of the slide button 40 and the cover 20, the combination of the slide button 40 and the cover 20 is assembled to the base 30 to enclose the base 30 with the circuit board 50 received therein. The slide button 40 on the cover 20 is aligned with the toggle switch 52 on the circuit board 50, with the tail fins 442 sandwiching the tip 520 therebetween.

When changing a current mode of the electronic device 99, the slide button 40 thereof is pushed to slide along the housing 220. The tip 520 of the toggle switch 52 is forced to sway or slide along with the slide button 40. A mode of the toggle switch 52 is changed, and the current mode of the electronic device 99 is thus changed accordingly.

In alternative embodiments, the tail fins 442 may be omitted, if the side fins 462 are structurally reachable by the tip 520 of the toggle switch 52. The structure of the slide button 40 is simpler than a two-piece type slide button. In other alternative embodiments, the tail fins 442 may be replaced by only one tail fin 442 formed along a center line of the connecting board 440 or a plurality of tail fins 442 distributed in uniform intervals on the connecting board 440.

The electronic device 99 utilizes the integrally formed slide button 40 of a single piece to simplify a structure thereof. The positioning portion 46 of the button 40 adopts a symmetrical structure to balance a weight thereof. Furthermore, the slide button 40 is easy to assemble as above mentioned and prevents the slide button 40 from disassembling due to blocking function of the bottom 226 of the housing 220. The slide button 40 can be utilized by many electronic devices, such as a portable computer, a DVD player, and a game player.

It should be emphasized that the above-described embodiments of the present invention, including any preferred embodiments, are merely possible examples of implementation of the principles of the invention, and are merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and be protected by the following claims.

What is claimed is:

1. An electronic device, comprising:

a cover with a housing therein, the housing including a bottom defining a first cutout and a second cutout therein;

a base coupled to the cover so as to form a receiving space;

a circuit board received in the receiving space, the circuit board including a switch mounted thereon; and a slide button mounted to the cover, the slide button including an operating portion, an activating portion, and a positioning portion, the operating portion slideably received in the housing for being operated to slide the operating portion in the housing, the activating portion extending from the operating portion through the first cutout and reaching the switch, the positioning portion connecting to the activating portion and spaced apart from the operating portion, the positioning portion inserted through the second cutout and blocked by the bottom from disengaging from the second cutout, the positioning portion comprising an extending board parallel to the operating portion and a pair of side fins extending from two opposite sides of the extending board for preventing the slide button from disengaging from the second cutout, each of the side fins comprising a wedge for easily inserting through the second cutout.

2. The electronic device as claimed in claim 1, wherein the activating portion comprises a connecting board substantially perpendicular to the operating portion and a pair of tail fins extending from two opposite sides of the connecting board.

3. The electronic device as claimed in claim 2, wherein each of the tail fins comprises a tab at a distal end thereof for activating the switch.

4. The electronic device as claimed in claim 3, wherein each of the tail fins comprises a round corner at a distal end thereof opposing to the corresponding tab for easily extending through the first cutout.

5. The electronic device as claimed in claim 3, wherein the switch comprises a tip extending therefrom to be activated by the tabs of the slide button.

6. The electronic device as claimed in claim 5, wherein the tip of the switch is positioned between the tabs of the slide button.

7. The electronic device as claimed in claim 1, wherein the operating portion comprises a plurality of projections for applying a pushing force thereon and anti-slip.

8. The electronic device as claimed in claim 1, wherein the operating portion defines a recess therein for aligning with a mark on the cover and indicating a status of the electronic device.

9. The electronic device as claimed in claim 1, wherein the operating portion comprises a pair of ribs for contacting with the bottom of the housing and decreasing a contacting area between the operating portion and the bottom.

10. A cover for an electronic device, the electronic device including a switch for shifting a mode thereof, the cover comprising:

a housing formed on a side wall of the cover, the housing including a bottom depressed from the side wall and a periphery surrounding the bottom, the bottom defining a first cutout and a second cutout communicating with the first cutout; and an integrally formed slide button attached to the cover, the slide button including an operating portion for being applied a pushing force thereon to slide the slide button, an activating portion for triggering the switch, and a positioning portion cooperating with the operating portion to sandwich the bottom therebetween, the activating portion inserted into the cover through the first cutout, the positioning portion inserted into the cover through the first and second cutouts, the activating portion comprising a connecting board substantially perpendicular to the operating portion and a pair of tail fins extending from two opposite sides of the connecting board, each of the tail fins comprising a tab at a distal end thereof for activating the switch.

11. The cover as claimed in claim 10, wherein each of the tail fins comprises a round corner at a distal end thereof opposing to the corresponding tab for easily extending through the first cutout.

12. The cover as claimed in claim 10, wherein the positioning portion comprises an extending board and a pair of side fins extending from two opposite sides of the extending board, each of the side fins comprised a wedge for easily inserting through the second cutout.

13. The cover as claimed in claim 12, wherein the activating portion comprises a connecting board substantially perpendicular to the operating portion and a pair of tail fins extending from two opposite sides of the connecting board.

14. The cover as claimed in claim 10, wherein the operating portion defines a recess therein for aligning with a mark on the cover to indicate a status of the electronic device.

15. The cover as claimed in claim 10, wherein the operating portion comprises a plurality of projections for increasing a friction thereof for anti-slip.

16. An electronic device, comprising:

a casing forming a button receiving portion;

a circuit board received in the casing;

a switch mounted on the circuit board, the switch including a tip moveable for performing switching; and a button moveably received in the button receiving portion, the button being a single piece and including a first portion for being applied a force on a first surface thereof to move the button along a moving direction, a second portion extending substantially perpendicularly from a second surface of the first portion opposite to the first surface, and a third portion positioning the button to the casing together with the first portion in a manner so as to prevent the button from becoming disengaged from the casing, the second portion being inserted into the casing so as to move the tip of the switch when the force is applied on the first portion; the third portion comprises at least one side fin including a wedge for being inserted into the electronic device by being gradually inserted and being crushed successively; wherein the second portion comprises at least one tail fin with a tab protruding from an end corner thereof for pushing tip of the switch and a round corner formed at an adjacent end corner for easily inserting the tab into the electronic device.

* * * * *